US010267112B2

(12) United States Patent
Clem et al.

(10) Patent No.: US 10,267,112 B2
(45) Date of Patent: Apr. 23, 2019

(54) DEBRIS BRIDGE MONITORING AND REMOVAL FOR UPHOLE MILLING SYSTEM

(71) Applicant: BAKER HUGHES, A GE COMPANY, LLC, Houston, TX (US)

(72) Inventors: Nicholas J. Clem, Houston, TX (US); Lei Fang, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 231 days.

(21) Appl. No.: 15/344,105

(22) Filed: Nov. 4, 2016

(65) Prior Publication Data

US 2018/0128071 A1 May 10, 2018

(51) Int. Cl.

| | |
|---|---|
| ***E21B 29/00*** | (2006.01) |
| ***E21B 47/09*** | (2012.01) |
| ***E21B 47/12*** | (2012.01) |
| ***E21B 33/13*** | (2006.01) |

(52) U.S. Cl.

CPC ..... *E21B 29/005* (2013.01); *E21B 33/13* (2013.01); *E21B 47/09* (2013.01); *E21B 47/12* (2013.01)

(58) Field of Classification Search

CPC ..... E21B 29/005; E21B 33/13; E21B 47/09; E21B 47/12

See application file for complete search history.

(56) References Cited

U.S. PATENT DOCUMENTS

| | | | | |
|---|---|---|---|---|
| 5,265,675 | A * | 11/1993 | Hearn | E21B 10/322 166/297 |
| 6,679,328 | B2 | 1/2004 | Davis et al. | |
| 7,562,700 | B2 | 7/2009 | Lewis et al. | |
| 7,708,086 | B2 | 5/2010 | Witte | |
| 8,555,955 | B2 | 10/2013 | Davis | |
| 8,875,810 | B2 | 11/2014 | Meister et al. | |
| 9,422,781 | B1 * | 8/2016 | Bennett | E21B 31/06 |
| 2003/0057366 | A1 * | 3/2003 | Gzara | E21B 44/00 250/269.3 |
| 2012/0040486 | A1 | 2/2012 | Rack | |
| 2014/0209383 | A1 | 7/2014 | Vuyk, Jr. | |
| 2015/0114665 | A1 * | 4/2015 | Hora | E21B 29/005 166/378 |
| 2016/0040486 | A1 | 2/2016 | Eppink et al. | |
| 2016/0040495 | A1 | 2/2016 | Mahajan et al. | |

* cited by examiner

*Primary Examiner* — Zakiya W Bates
*Assistant Examiner* — Crystal J Miller
(74) *Attorney, Agent, or Firm* — Shawn Hunter

(57) ABSTRACT

A bottom hole assembly (BHA) contains a motor and a section mill for milling in an uphole direction after blade extension with circulating fluid through the BHA. Below the section mill is sensing equipment to detect location of a bridge formed by the cuttings or swarf from the section mill. A secondary mill oriented for cutting in a downhole direction is located at the bottom of the BHA for use in removal of the bridge. The sensing equipment delivers in real time data as to the density of the bridge so that decisions to interrupt the section milling and to lower the secondary mill to the bridge can be made in real time. Cement is pumped and displaced by a wiper plug to plug and abandon the hole.

19 Claims, 5 Drawing Sheets

DEBRIS BRIDGE MONITORING AND REMOVAL FOR UPHOLE MILLING SYSTEM

FIELD OF THE INVENTION

The field of the invention is an uphole milling system and more particularly where the location and characteristics of a debris bridge above the rat hole is monitored in real time.

BACKGROUND OF THE INVENTION

Milling one or more strings in an uphole direction in a single trip are discussed in U.S. Pat. No. 8,555,955. Uphole milling is also described in U.S. Pat. No. 6,679,328. Grinding cuttings moving uphole from a mill for a second time to reduce their size so that they can be circulated out of a borehole are described in US 20160040496 and 20160040495. Drilling systems that monitor parameters such as fluid circulation rates as well as borehole parameters such as rat hole depth as well as a cuttings removal rate to allow real time changing of drilling parameters are described in US 20140209383.

When milling in an uphole direction the cuttings are allowed to go to hole bottom frequently referred to as the rat hole. If the cuttings fall to hole bottom as planned there is no problem later with plugging and abandoning the borehole with cement placed within the section of hole that was removed by milling. On the other hand, if the cuttings bridge the borehole close to the mill location, the milling itself can be affected or the position of the bridge can impact the ability to place cement so that the well will be not properly sealed when the cement is pumped into position where the casing was milled out.

The present invention seeks to address this issue in several ways. The uphole mill assembly has a signaling capability to determine whether or not a bridge is forming and if the bridge is forming the system can detect its location and its density in real time. The uphole milling assembly contains a downhole oriented mill or similar device that can be brought against the bridge to grind up the bridge so that uphole milling can resume. These and other aspects of the present invention will be more readily apparent from a review of the description of the preferred embodiment and the associated drawings while recognizing that the full scope of the invention is to be determined from the appended claims.

SUMMARY OF THE INVENTION

A bottom hole assembly (BHA) contains a motor and a section mill for milling in an uphole direction after blade extension with circulating fluid through the BHA. Below the section mill is sensing equipment to detect location of a bridge formed by the cuttings, or swarf, from the section mill. A secondary mill oriented for cutting in a downhole direction is located at the bottom of the BHA for use in removal of the bridge. The sensing equipment delivers in real time data as to the density of the bridge so that decisions to interrupt the section milling and to lower the secondary mill to the bridge can be made in real time. After the required length of section is milled, and the sensor has confirmed that the milled interval is sufficiently clean to set a barrier, cement is pumped to form a plug within that section and abandon the hole.

BRIEF DESCRIPTION OF THE DRAWINGS

FIG. 1 shows the BHA being run in;

DETAILED DESCRIPTION OF THE PREFERRED EMBODIMENT

Figure 1:
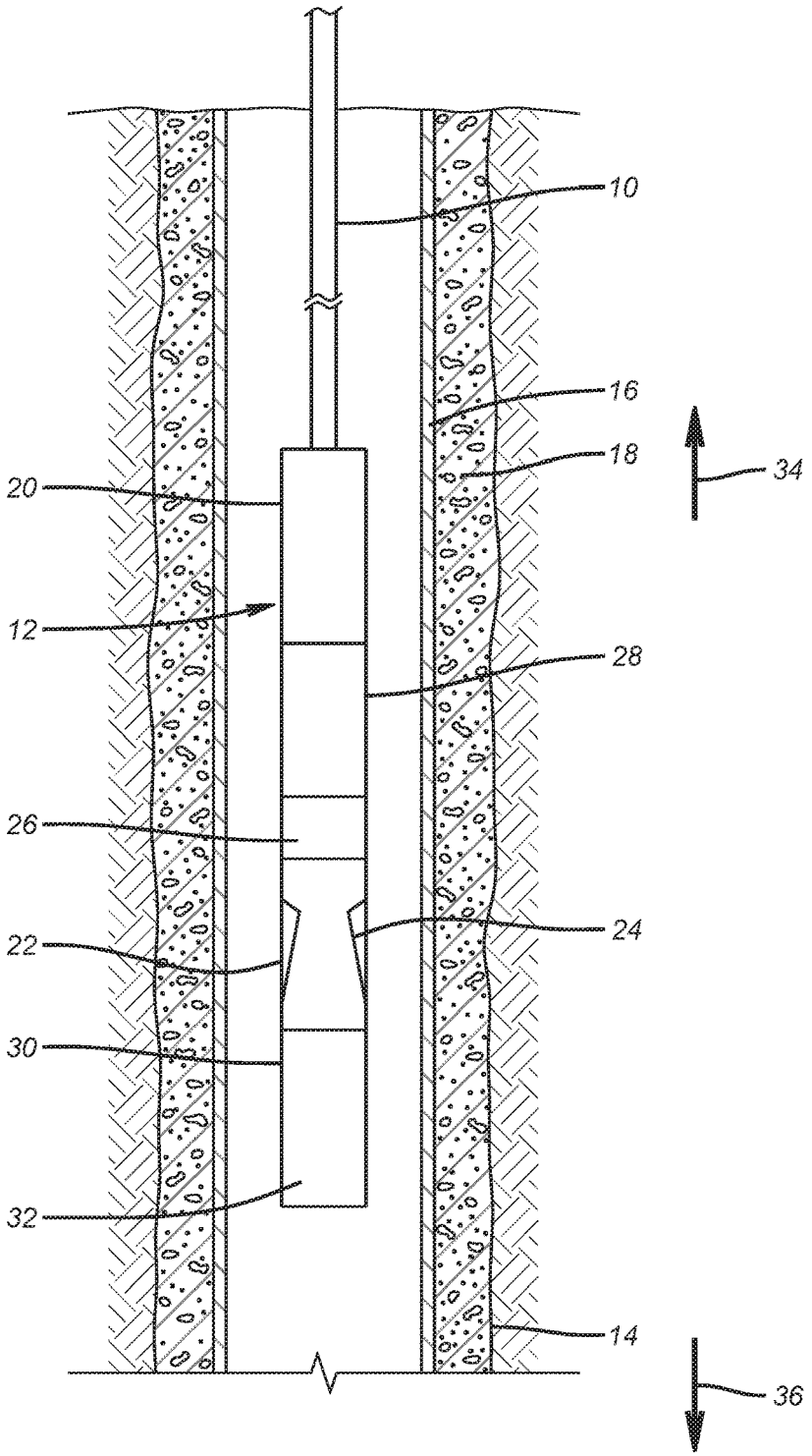

Referring to FIG. 1, drill pipe 10 or an equivalent conduit supports a BHA 12 in borehole 14. The borehole has a casing 16 that is sealed with cement 18. The BHA 12 features a motor assembly 20 that can include a progressing cavity stator and rotor combination to generate a rotational force for turning the section mill 22 shown with its blades 24 retracted for running in. The flow through the motor assembly 20 exits the BHA at least in part through the jet sub 26 which is essentially a ported sub. A power and communication module 28 is shown between motor assembly 20 and jet sub 26 but can be located elsewhere in the BHA 12. Below the section mill 22 is a signal sub 30 and secondary mill 32 that can be one or multiple tools is at the bottom of the BHA 12. Section mill 22 cuts in an uphole direction represented by arrow 34. Secondary mill 32 cuts in a downhole direction represented by arrow 36. Secondary mill 32 is optional and bridge 46 can be removed with fluid jetting or a laser or other non-mechanical techniques.

Figure 2:
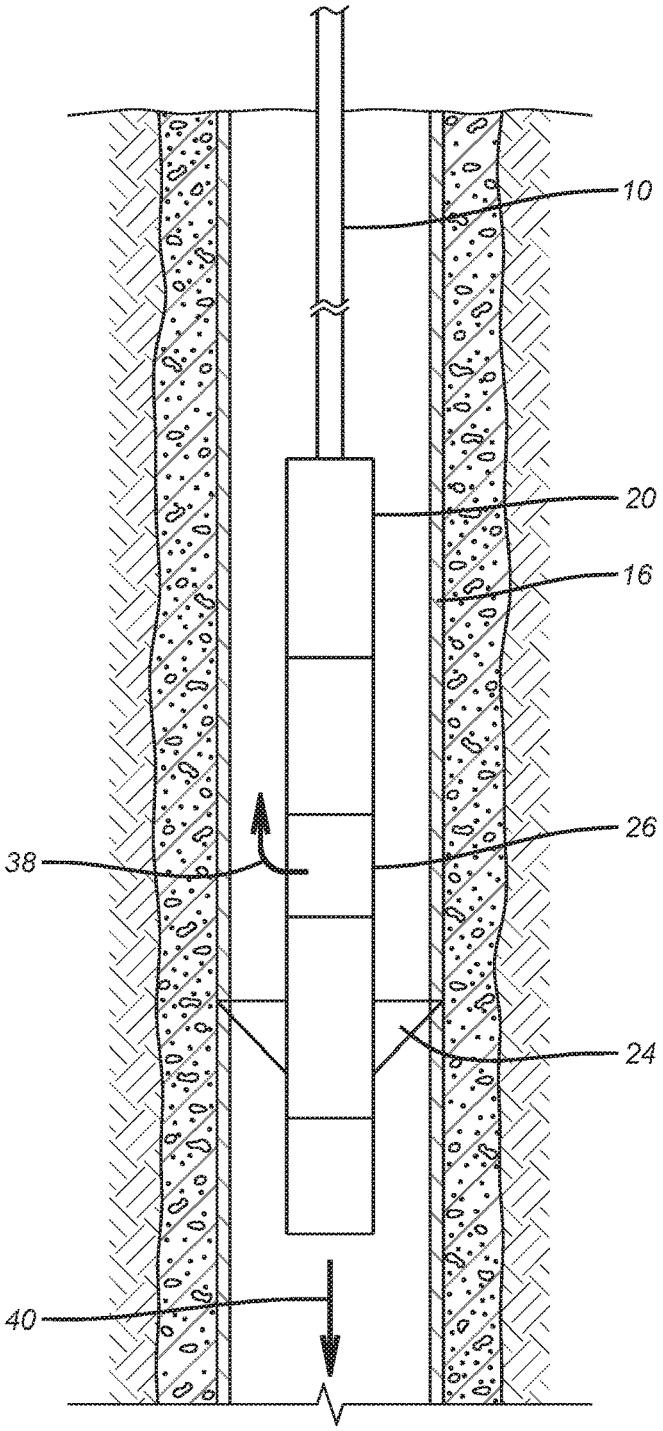
FIG. 2 is the view of FIG. 1 with the section mill activated for uphole milling.

FIG. 2 shows blades 24 extended against the casing with the drill string 10 providing an uphole force in the direction of arrow 34 as the motor assembly 20 rotates the blades. Most of the delivered flow to motor assembly 20 exits the jet sub 26 and flows uphole in the direction of arrow 34. This circulation flow is schematically illustrated by arrow 38. Some of the flow is directed in a downhole direction out the bottom of the secondary mill 32 as schematically illustrated by arrow 40. It should be noted that blades 24 rotate in tandem with secondary mill 32 when the motor assembly 20 is activated with flow from the drill string 10. In FIG. 2 only blades 24 are cutting through and uphole on the casing 16.

Figure 3:
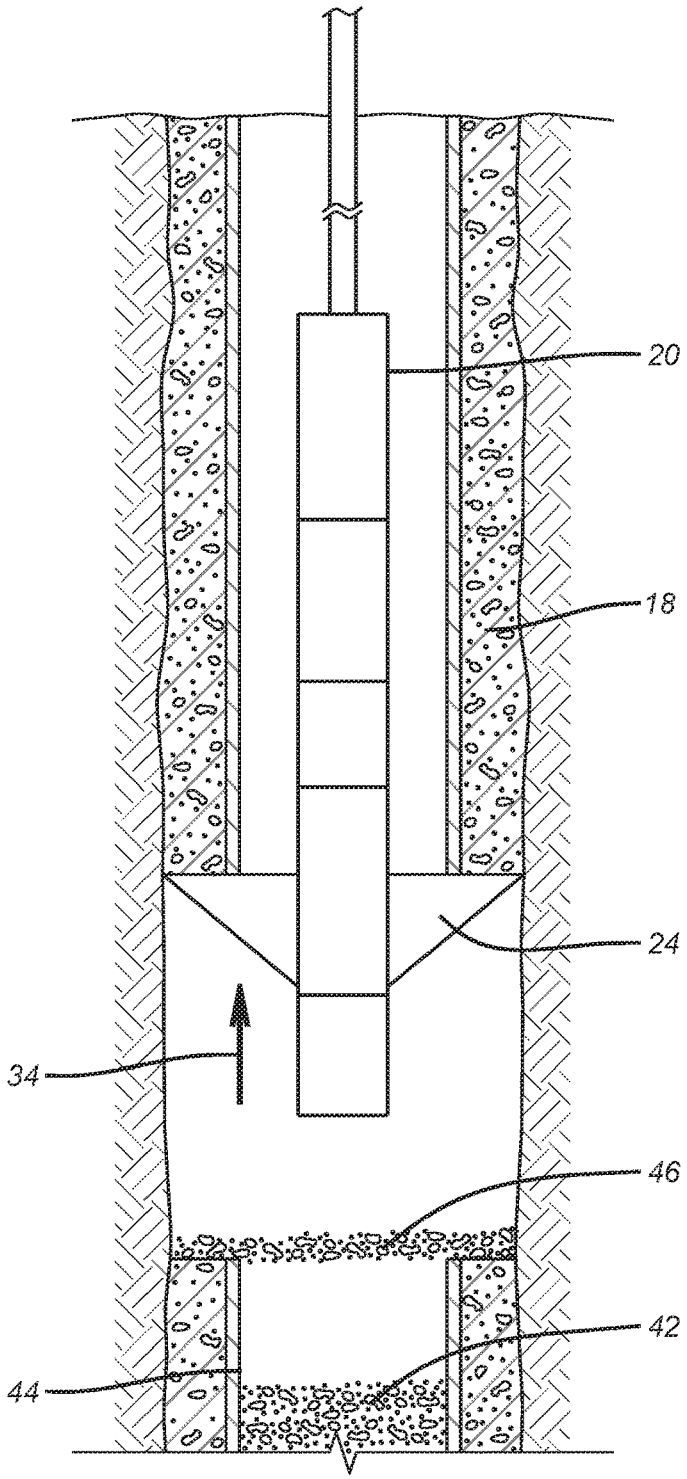
FIG. 3 shows the onset of uphole milling and the formation of a bridge.

FIG. 3 shows a part of the casing 16 milled away as the blades 24 have moved uphole in the direction of arrow 34 while being rotated by the motor assembly 20. Some, or all, of the cement 18 has also been milled out. The milling by blades 24 results in cuttings 42 falling into rat hole 44 if all goes as planned. However some of the cuttings 46 can bridge above the rat hole 44 as shown in FIG. 3.

Figure 4:
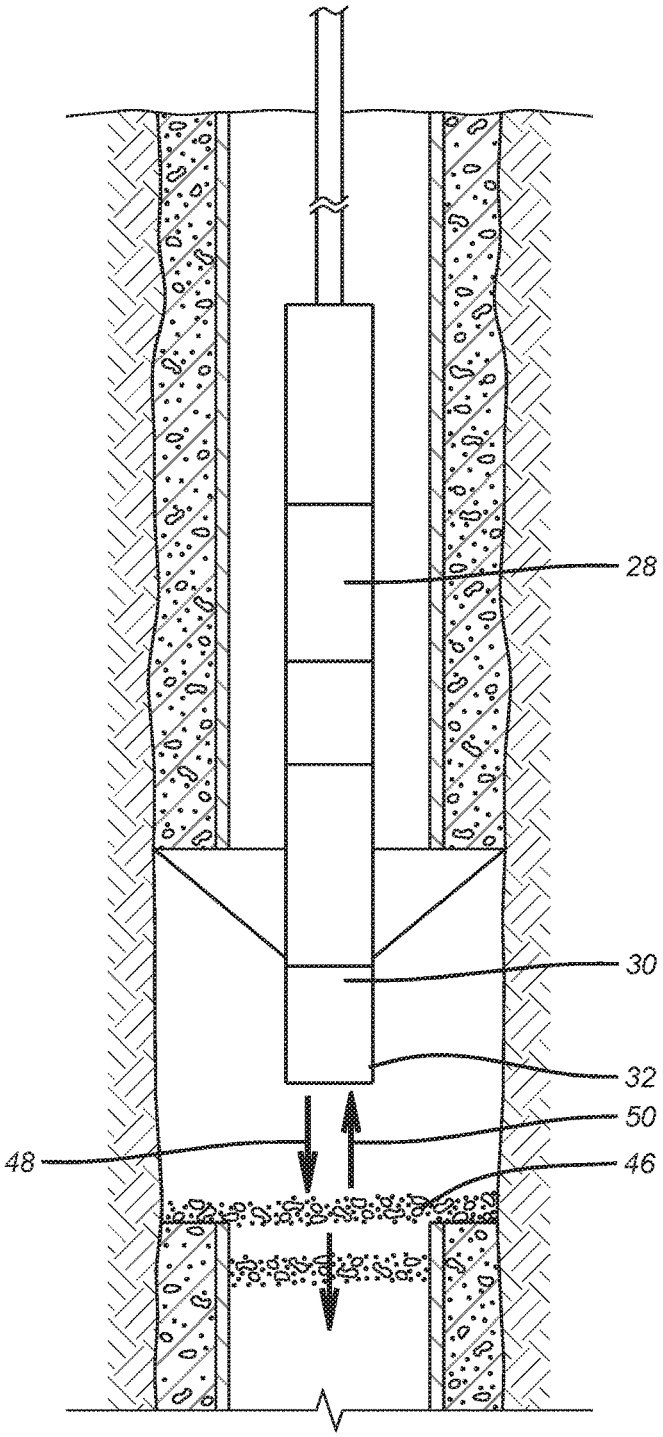
FIG. 4 shows the presence and properties of the bride being sensed in real time.
Figure 5:
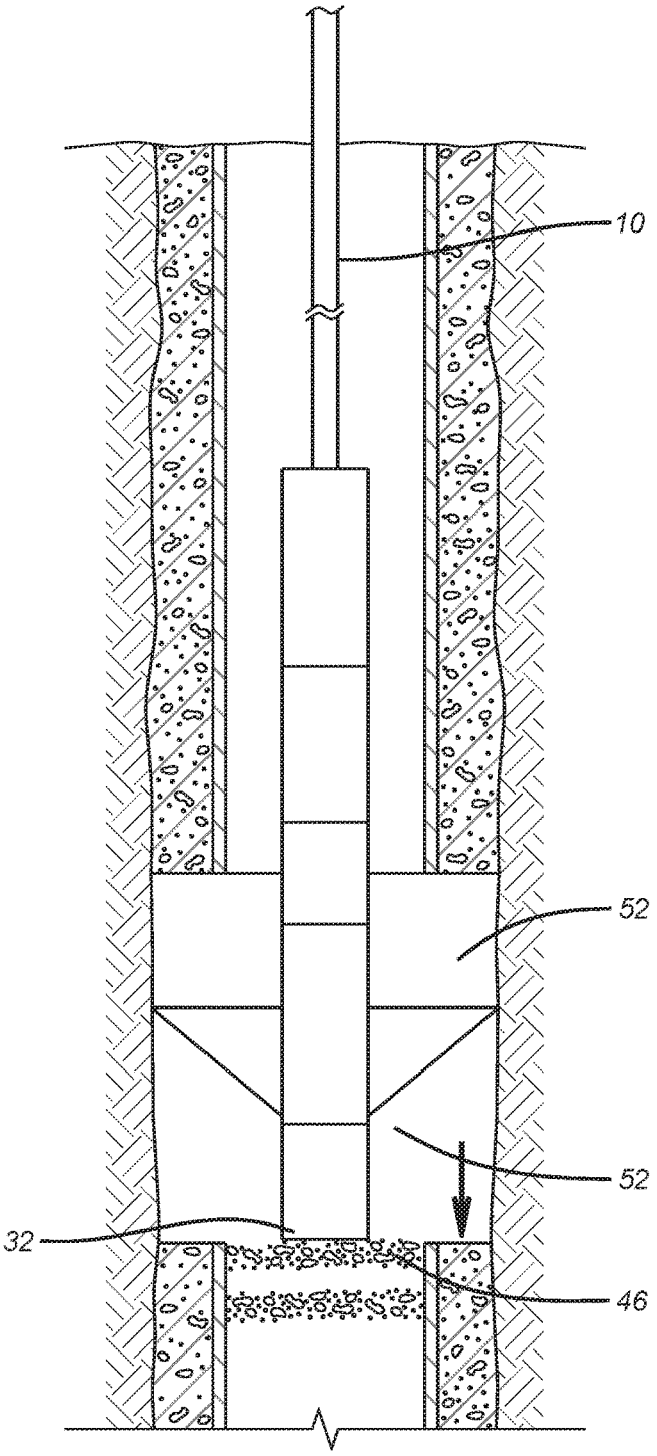
FIG. 5 shows the section milling interrupted and the bridge being milled out with a secondary mill on the BHA.

FIG. 4 illustrates the signal sub 30 sending real time signals represented by arrow 48 to detect the location and density of the debris bridge 46. Depending on the time and strength of a return signal schematically represented by arrow 50 the power and communication module 28 in combination with the signal module 30 results in data transmission to the surface in real time regarding the location and density of the debris bridge 46. This information is used by surface personnel to lower the BHA 12 until the secondary mill 32 engages the debris bridge 46 to remove it. The BHA 12 can then be picked up to continue uphole milling with blades 24.

When the milling is finished, a cement plug followed by a cement wiper are pumped down the string 10, or the BHA 12 is removed from the borehole and cement is pumped through a secondary BHA for cementing, into void 52 so that the well is plugged and can be abandoned in conformance with local regulations.

While the preferred signaling system for location and density of the debris bridge 46 is acoustic, other signal types are envisioned and those that can gather information on the bridge 46 while blades 24 are cutting are envisioned as well. Wired systems with coiled tubing are also envisioned for power and data transmission. Use of coiled tubing may entail an anchor to prevent the stator of pump system 20 from rotating. Battery powered mud pulse systems or other downhole wireless communication techniques, e.g. acoustics and electromagnetic, are also contemplated. Data can be stored locally while being transmitted in real time. Another real time data system that can be used is described in U.S. Pat. No. 8,875,810 whose contents are incorporated by reference herein as if fully set forth.

The disclosed system envisions and uphole and downhole mill on the same BHA to provide the ability to mill up and to break up debris bridges by setting down weight and milling down. Both mills can have hydraulically or electrically actuated blades using the pumped fluid to drive the downhole motor. The cuttings that are formed can be re-milled by an attrition device before reaching the rat hole to reduce the chance of a bridge forming. Downward oriented flow stream 40 can also agitate the cuttings and reduce the probability of bridge formation. Alternatively the cuttings can be attracted to the rat hole with magnets delivered on the BHA and dropped when the lower end of the BHA is adjacent the rat hole.

The above description is illustrative of the preferred embodiment and many modifications may be made by those skilled in the art without departing from the invention whose scope is to be determined from the literal and equivalent scope of the claims below:

We claim:

1. A tubular milling bottom hole assembly for a borehole extending from a surface location to a rat hole, comprising: a primary mill oriented for milling in an uphole direction toward the surface location; a secondary mill oriented to mill in a downhole direction toward said rat hole; said primary mill removing at least the tubular and generating cuttings which form a bridge in the tubular before falling to the rat hole, said secondary mill removing said bridge; and a real time sensing and sensed data transmission system on said bottom hole assembly to detect at least one of location and density of the bridge and transmit to the surface location.

2. The assembly of claim 1, further comprising:
a fluid motor driver for said primary and secondary mills;
a jet sub to direct pumped fluid operating said fluid motor driver laterally out of the bottom hole assembly uphole of said primary mill.

3. The assembly of claim 2, further comprising:
a passage through the bottom hole assembly through said secondary mill to direct at least some of said pumped fluid in a direction toward the rat hole.

4. The assembly of claim 1, further comprising: a power supply for said sensing and sensed data transmission system mounted in said bottom hole assembly.

5. The assembly of claim 4, further comprising:
an attrition device to further reduce cuttings in size after said cuttings are generated by said primary mill and start to fall toward the rat hole.

6. The assembly of claim 4, further comprising:
an attracting device delivered to the rat hole by the bottom hole assembly to draw cuttings into the rat hole.

7. A tubular milling bottom hole assembly for a borehole extending from a surface location to a rat hole, comprising:
a primary mill oriented for milling out the tubular in an uphole direction toward the surface;
a real time sensing and sensed data transmission system on said bottom hole assembly to detect at least one of location and density of a cutting bridge between said primary mill and the rat hole and transmit to the surface location so that the cutting bridge can be reduced with a force within the borehole delivered from the bottom hole assembly in a downhole direction by a device other than said primary mill.

8. The assembly of claim 7, further comprising:
a fluid motor driver for said primary mill;
a jet sub to direct pumped fluid operating said fluid motor driver laterally out of the bottom hole assembly uphole of said primary mill.

9. The assembly of claim 8, further comprising:
a passage through the bottom hole assembly to direct at least some of said pumped fluid in a direction toward the rat hole.

10. The assembly of claim 7, further comprising:
a power supply for said sensing and sensed data transmission system mounted in said bottom hole assembly.

11. The assembly of claim 7, further comprising:
an attrition device to further reduce cuttings in size after said cuttings are generated by said primary mill and start to fall toward the rat hole.

12. The assembly of claim 7, further comprising:
an attracting device delivered to the rat hole by the bottom hole assembly to draw cuttings into the rat hole.

13. The assembly of claim 7, further comprising:
said cutting bridge is removed without physical contact by the bottom hole assembly.

14. A borehole milling method, comprising
milling out a tubular in an uphole direction with a mill;
generating cuttings that drop to a rat hole;
sensing at least one of a cuttings bridge location and a cuttings bridge density;
transmitting data from said sensing in real time to surface location;
removing said cuttings bridge within the borehole in response to said transmitted data in a downhole direction with a device other than said mill.

15. The method of claim 14, comprising:
removing said cuttings bridge with at least one of a secondary mill, a fluid jet or a laser.

16. The method of claim 14, comprising:
plugging the borehole with cement into the location of said uphole milling.

17. The method of claim 16, comprising:
performing said plugging in the same trip as said milling out.

18. The method of claim 14, comprising:
providing an attrition device to further reduce cuttings in size after said cuttings are generated by said primary mill and start to fall toward the rat hole.

19. The method of claim 14, comprising:
delivering an attracting device to the rat hole to draw cuttings into the rat hole.

* * * * *